United States Patent [19]

Wolff

[11] Patent Number: 5,048,188

[45] Date of Patent: Sep. 17, 1991

[54] RABBET CUTTING TOOL

[76] Inventor: Douglas F. Wolff, P.O. Box 106, Ceresco, Mich. 49033-0106

[21] Appl. No.: 582,678

[22] Filed: Sep. 13, 1990

[51] Int. Cl.[5] ..... B26B 29/00; B26D 3/00; B26D 1/00

[52] U.S. Cl. ..... 30/288; 30/294; 30/289

[58] Field of Search ..... 30/280, 283, 288, 289, 30/293, 294, 228, 237

[56] References Cited

U.S. PATENT DOCUMENTS

| | | | |
|---|---|---|---|
| 421,717 | 2/1890 | Hunt . | |
| 944,859 | 12/1909 | Harris . | |
| 2,442,694 | 6/1948 | Keiser . | |
| 2,456,436 | 12/1948 | Metzger . | |
| 3,585,720 | 6/1991 | O'Neal . | |
| 3,791,014 | 2/1974 | Perna | 34/294 |
| 4,064,626 | 12/1977 | Meshulam et al. | 34/294 |
| 4,064,627 | 12/1977 | Zanfini . | |
| 4,495,697 | 1/1985 | Ruff | 30/288 |
| 4,667,409 | 5/1987 | D'Amato | 30/289 |

*Primary Examiner*—Douglas D. Watts
*Assistant Examiner*—Paul M. Heyrana, Sr.
*Attorney, Agent, or Firm*—Price, Heneveld, Cooper, DeWitt & Litton

[57] ABSTRACT

A cutting tool for cutting a rabbet along the edge of a board material for constructing a rabbet joint which includes a body or holder. The body positions a cutting blade in two slots defined by the body. The blade is positioned in the slots so that the edge of a panel can be cut in one slot and the surface of the panel can be cut in the other slot to form a rabbet along the edge of the panel.

8 Claims, 3 Drawing Sheets

RABBET CUTTING TOOL

BACKGROUND OF THE INVENTION

The present invention relates to cutting devices and more specifically to cutting devices for making a rabbet joint for joining two boards or panels.

Foam core sheets or panels having a center core of foam sandwiched between outer sheets of paper are commonly used in the making of architectural models and other artwork. The sheets are typically cut and joined using glue. In joining two panels of material, it is common to simply butt the edge of one panel against the face of another panel, near its edge, to form a corner joint between the two panels. However, this leaves the edge and foam core of the second panel exposed. If the model is painted, the foam core absorbs the paint more than the paper outer sheets resulting in color difference. Also, a butt joint is one of the weakest joints which can be made between two pieces of material. Thus, it is sometimes aesthetically and structurally desirable to use a rabbet joint to form a corner between two pieces of material. Generally, this is done manually using a single, sharp knife or cutter. However, this can be a tedious and difficult task, often requiring a craftsman's skill.

SUMMARY OF THE INVENTION

The present invention greatly simplifies the procedure for making a rabbet joint and overcomes the above noted problems. Essentially, a simple tool is provided for holding and guiding a cutting blade to make two cuts along the edge of a board or panel. The tool is used to cut out a notch along the edge of the material for making a rabbet joint.

DESCRIPTION OF THE PREFERRED EMBODIMENT

Figure 1:
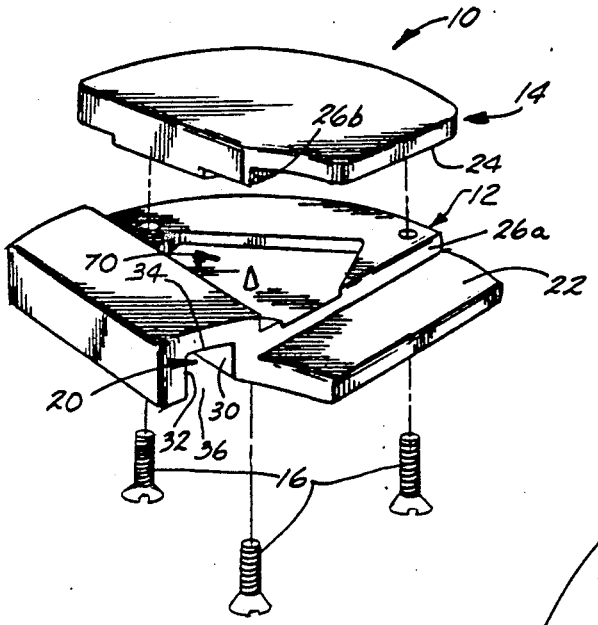
FIG. 1 is an exploded perspective view of a tool in accordance with the present invention.
Figure 2:
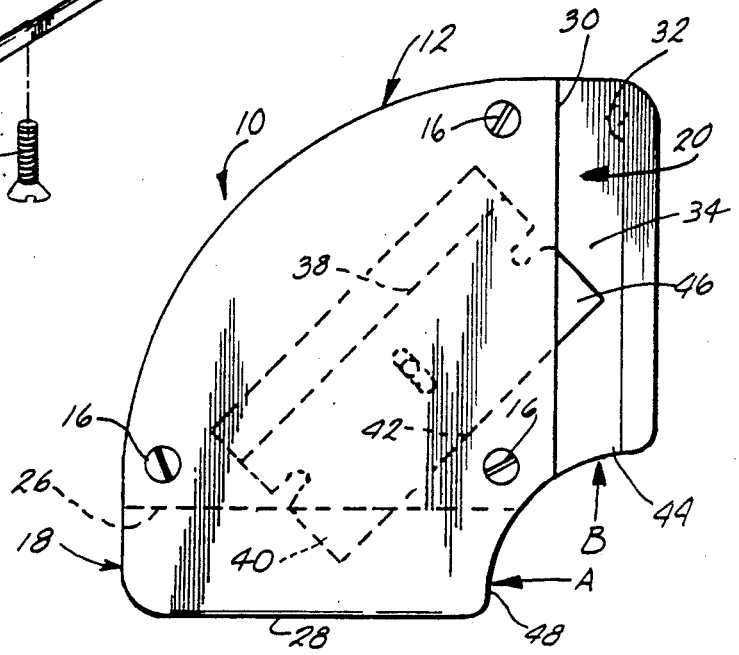
FIG. 2 is a plan view of the invention.
Figure 3:
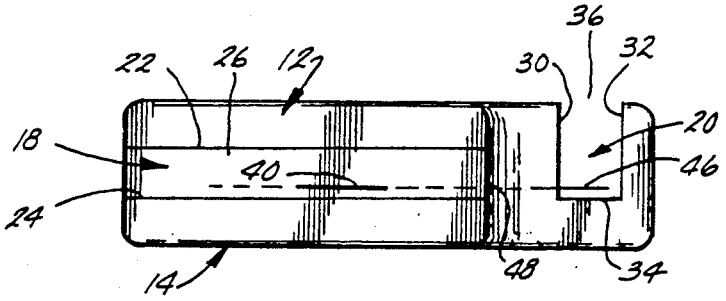
FIG. 3 is an end elevational view of the invention taken along line III—III of FIG. 2.

A preferred embodiment of the present invention is shown in FIGS. 1-3 and is generally designated by the numeral 10. Cutting tool 10 of the present invention includes a base 12 and a cover 14 which are fastened together by three screws 16 (FIG. 1). A slot 18 is formed between base 12 and cover 14 and a slot 20 is formed in base 12.

Slot 18 is defined by two generally parallel opposing wall portions 22 and 24 of the base 12 and cover 14 respectively and two generally coplanar wall portions

26*a* and 26*b* of the base 12 and cover 14 respectively, forming slot bottom 26. Slot 18 is formed when the base 12 and cover 14 are assembled together. Slot 18 has an open side 28. Slot 20 is defined by two generally parallel opposing walls 30 and 32 and a bottom 34. Slot 20 has an open side 36.

A common single edge razor blade 38 is captured between cover 14 and base 12 in a blade receiving area 70 in the embodiment shown (FIG. 1). While the blade receiving area 70 shown specifically accommodates a single edge razor blade 38, a double edge razor blade could be used and it would be a simple matter to configure receiving area 70 to accommodate a common utility knife blade. Blade 38 is positioned in tool 10 such that one end 40 of the cutting edge 42 of blade 38 projects a predetermined distance into slot 18, through bottom 26, between wall portions 26*a* and 26*b*, at a predetermined distance from wall 22. The other end 46 of edge 42 of blade 38 projects a predetermined distance into slot 20, through a slot-shaped aperture in wall 30, at a predetermined distance from bottom 34.

Figure 4A:
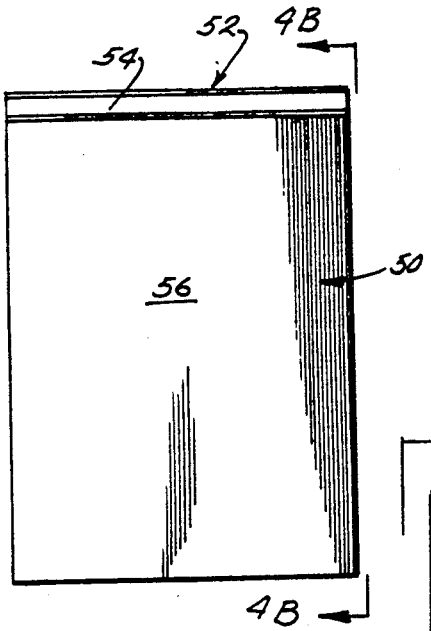
FIG. 4*a* is an elevational view as indicated by arrows A—A in FIG. 4*b* of two panels connected by a butt joint to form a corner.
Figure 4B:
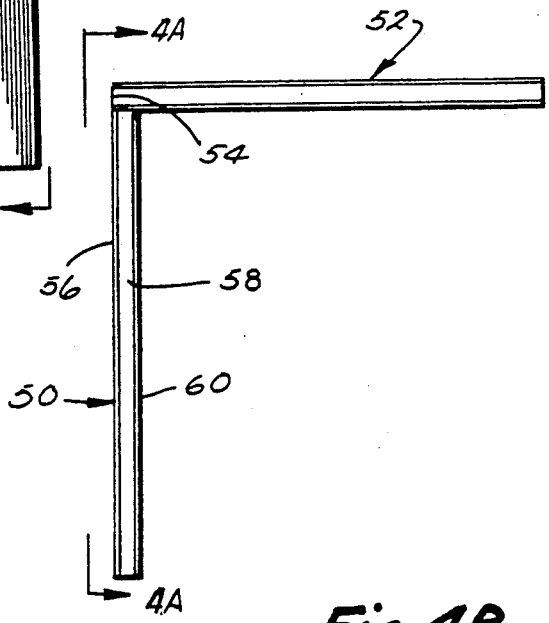
FIG. 4*b* is an elevational view as indicated by arrows A—A in FIG. 4*a*.
Figure 5:
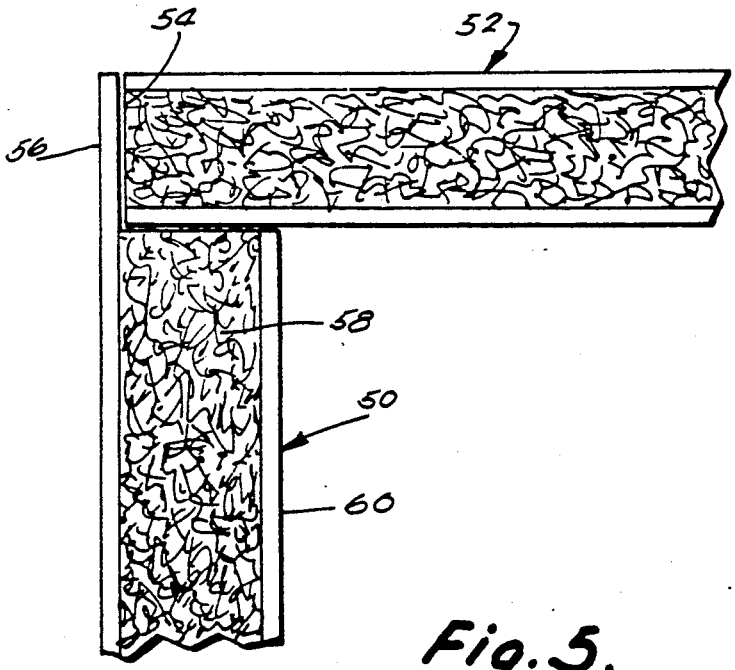
FIG. 5 is an edge view showing two panels connected with a rabbet joint resulting from the use of the present invention.
Figure 8:
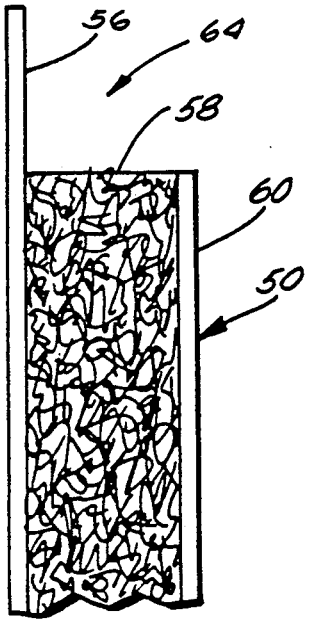
FIG. 8 is an edge view of a panel showing the rabbet resulting from the use of the invention.

As seen in FIGS. 4*a* and *b*, forming a corner between two foam core architectural panels 50 and 52, for example, with a common butt joint, leaves the edge 54 of panel 52 exposed. However, as shown in FIG. 5, the use of a rabbet allows a thin layer of material along the surface 56 of panel 50 to lap over and cover edge 54 of panel 52.

Figure 6:
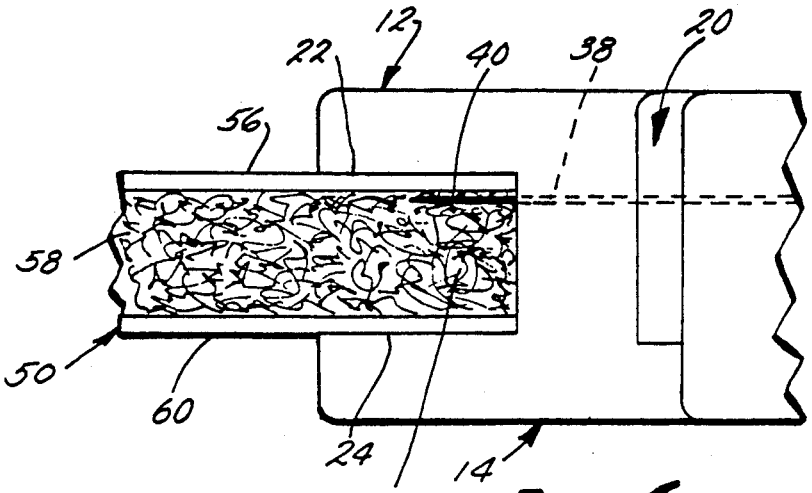
FIG. 6 is a fragmentary elevational view showing the use of the present invention to cut the edge of a panel.

Cutting tool 10 is used to cut a rabbet along the edge of a panel, panel 50 for example, by inserting the edge of panel 50 through open side 28, into slot 18 (FIG. 6). Slot bottom 26 of slot 18 is pressed against the edge of panel 50 and tool 10 is drawn along the panel edge so that the panel edge is fed lengthwise through slot 18 in the direction indicated by arrow A, FIG. 2. Thus, the edge of panel 50 is cut, so that a thin layer of material along surface 56 of panel 50 is separated from the core 58 of panel 50 by end 40 of blade 38.

Figure 7:
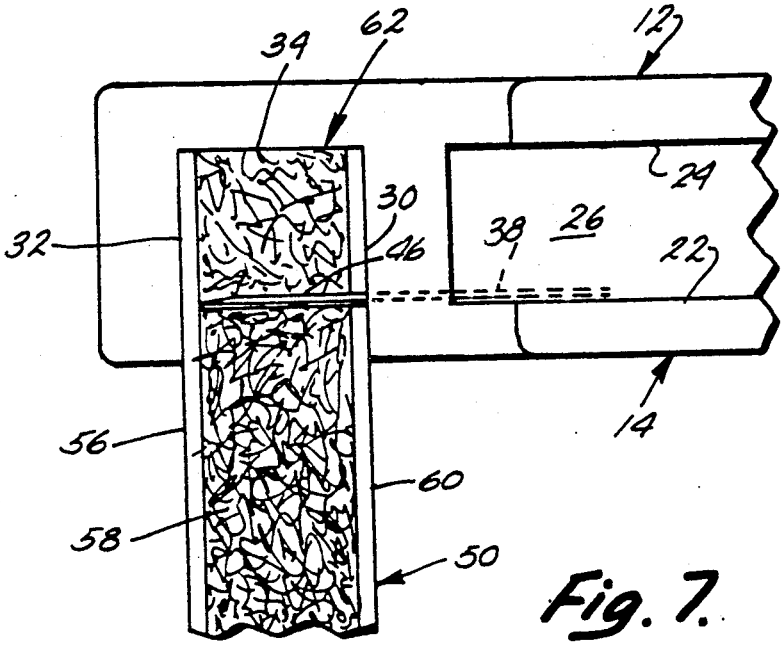
FIG. 7 is a fragmentary elevational view showing the use of the present invention to cut the surface of a panel.

The same edge of panel 50 is then inserted through open side 36, near end 64, into slot 20 of tool 10 (FIG. 7). Slot bottom 34 of slot 20 is pressed against the panel edge and tool 10 is again drawn along the length of the panel edge, moving along the panel edge in the same direction as when the first cut was made, so that the panel edge is fed lengthwise through slot 20 in the direction indicated by arrow B, FIG. 2. Thus, end 46 of blade 38 cuts through surface 60 and core 58, leaving a thin layer of material along surface 56 uncut.

Use of the tool results in a strip of material 62 which is cut free from the edge of panel 50 and is easily removed to reveal the rabbet 64. The end 54 of panel 52 is seated in rabbet 64 to form a rabbet joint corner as shown in FIG. 5. Conversely, surface 60 and core 58 can be cut in slot 20 prior to cutting the edge of panel 50 in slot 18.

The above description is considered to be that of the preferred embodiment only. While the embodiment described above and shown in the figures is specifically directed to the function of cutting a rabbet along the edge of a foam core architectural panel, the scope of the invention as claimed is not intended to be so narrowly defined and is intended to apply to any situation wherein it is desired to cut a rabbet along the edge of a piece of material to construct a rabbet joint. The invention is adaptable to drywall construction, insulation board construction and wood construction, for example. Other modifications of the invention will occur to those who make or use the invention. Therefore it is understood that the embodiment shown in the drawings and described above is merely for illustrative purposes and is not intended to limit the scope of the invention, which is defined by the following claims as interpreted according to the principles of patent law.

The embodiments of the invention in which an exclusive property or privilege is claimed are defined as follows:

1. A blade holder for a rabbeting tool used in cutting a rabbet in a board material, said tool comprising a body for holding and guiding a cutting blade, said body having a first cutting slot into which a portion of the blade extends used for cutting the edge of the board material and a second cutting slot into which another portion of the blade extends used for cutting the face of the board material near an edge, the edge cut and the face cut intersecting so that a notch is cut into the edge of said board material for making a rabbet joint.

2. A blade holder as defined by claim 1 wherein each of said slots is a generally U-shaped channel having a bottom wall with two opposing sidewalls extending from said bottom and has an open side opposite said bottom; and wherein the length of said first slot runs generally perpendicular to the length of said second slot.

3. A blade holder as defined by claim 2 wherein said body is configured to position a blade so that the blade projects a predetermined distance into each of said slots.

4. A blade holder as defined by claim 3 wherein said body is configured to position the blade so that it projects through said bottom of said first slot at a predetermined distance from one of said sidewalls and the blade projects through one of said two sidewalls of said second slot at a predetermined distance from said bottom.

5. A cutting tool for use with board of the type having a foam core sandwiched between paper sheets, said tool comprising:

a two piece holder having a base and a cover, said base and cover defining a first, elongated generally U-shaped slot having an open side and a second, elongated generally U-shaped slot having an open side, said first slot having a bottom and said second slot having a bottom extending generally perpendicular to said bottom of said first slot; and a cutting blade held between said base and cover of said holder, said blade having a cutting edge extending into said slots.

6. A cutting tool as defined by claim 5 wherein each of said slots further includes opposed, parallel side walls, said cutting edge extending through the bottom of said first slot and through one of said side walls of said second slot.

7. A cutting tool as defined by claim 6 wherein said base of said holder defines a generally rectangular blade receiving area.

8. A cutting tool as defined by claim 7 further including fasteners for holding said cover and base together.

* * * * *